US006070907A

United States Patent [19]

Bujold et al.

[11] Patent Number: 6,070,907

[45] Date of Patent: Jun. 6, 2000

[54] SAFETY ATHLETIC POLE

[76] Inventors: Edward J. Bujold, 9 Forest Ave., Granite Falls, N.C. 28630; Eugene P. Wise, 345 21st Ave. Dr. NW., Hickory, N.C. 28601-1867

[21] Appl. No.: 09/221,366

[22] Filed: Dec. 28, 1998

Related U.S. Application Data

[60] Provisional application No. 60/073,326, Feb. 2, 1998, and provisional application No. 60/097,203, Aug. 20, 1998.

[51] Int. Cl.[7] ..... A63C 11/22

[52] U.S. Cl. ..... 280/821; 16/112; 135/65; 403/166

[58] Field of Search ..... 280/819, 821, 280/822; 135/82, 84, 76, 65; 16/112; 403/166, 119

[56] References Cited

U.S. PATENT DOCUMENTS

| | | | |
|---|---|---|---|
| 637,668 | 11/1899 | Rison . | |
| 1,388,719 | 8/1921 | Johnston . | |
| 1,674,983 | 6/1928 | Morton | 403/166 |
| 1,743,241 | 1/1930 | Schmidt | 403/166 |
| 2,474,690 | 6/1949 | Robinson et al. . | |
| 2,475,406 | 7/1949 | Russell | 403/166 |
| 2,799,970 | 7/1957 | Baggott | 403/166 |
| 2,946,600 | 7/1960 | Cubberley . | |
| 3,524,324 | 8/1970 | Miklos . | |
| 3,730,544 | 5/1973 | Hyman . | |
| 3,797,845 | 3/1974 | Kepka et al. . | |
| 4,229,016 | 10/1980 | Wolf . | |
| 4,332,399 | 6/1982 | Kepple . | |
| 4,597,589 | 7/1986 | Fujii et al. . | |
| 4,775,168 | 10/1988 | Daleboot . | |
| 5,114,186 | 5/1992 | Sugiyama . | |
| 5,139,283 | 8/1992 | Dow et al. . | |

*Primary Examiner*—Michael Mar
*Attorney, Agent, or Firm*—Adams Law Firm, P.A.

[57] ABSTRACT

An athletic pole adapted for minimizing injuries to the hand and wrist of the user in the event of an accident. The pole includes a handle having an enlarged handle base, a shaft extending from the handle and including a proximal end adjacent the handle, a distal end, and an enlarged shaft base on the proximal end that normally engages the handle base. The pole also includes an attachment device for attaching the handle to the shaft and a biasing device exerting sufficient tension on the attachment device for biasing the attachment device to maintain the handle base and the shaft base in a mating, coaxial position during normal use. The periphery of the handle base and the periphery of the shaft base collectively form a fulcrum point for permitting controlled, tensioned articulation of the handle relative to the shaft. Such articulation results when a predetermined bending force is applied to the pole that is sufficient to overcome the tension of the biasing device on the attachment device.

17 Claims, 7 Drawing Sheets

SAFETY ATHLETIC POLE

TECHNICAL FIELD AND BACKGROUND OF THE INVENTION

This application corresponds to U.S. Provisional Patent Application Ser. Nos. 60/073,326 and 60/097,203, filed on Feb. 2, 1998 and Aug. 20, 1998, respectively. This application claims priority to U.S. Provisional Patent Application Ser. No. 60/073,326 filed on Feb. 2, 1998.

The invention described herein is a safety athletic pole designed for use in a variety of athletic activities including, among others, hiking and skiing. To maximize clarity but without imposing a limitation, discussion of the invention is hereafter directed toward its potential embodiment as a ski pole.

The traditional ski pole is composed of a handle, a long, thin, rigid shaft with a pointed tip, and a basket near the tip to restrict snow penetration. The ski pole assists skiers in maneuvering efficiently in various skiing terrains and under an assortment of snow and terrain conditions. While using ski poles, a skier, whether skiing downhill or cross country, may sustain significant injuries from the simplest of falls. To minimize this danger, novice skiers are taught to release their poles or attempt to keep their arms close to their body. Recent ski pole handle design attempts to make release easier, but experience indicates that, in actuality, little has been done to prevent a number of ski pole-related upper extremity injuries.

When falling, the natural tendency is to hold the poles tighter and brace the fall with outstretched arms. The resulting positions put the thumb at a significant biomechanical disadvantage. Abnormal forces applied to the thumb in this manner often cause injury to the ligamentous tendon complex, joint capsule, and bones. One of the most disabling injuries often acquired from such a fall is a complete tear of the ulna collateral ligament of the thumb. Statistically, this injury ranks as the second most common reported injury in skiing (knee injuries ranking first). If one includes unreported injuries, it may be the most common injury in skiing. Many skiers we have interviewed have spent six to nine months recovering from injured thumbs for which they never sought medical attention. At first glance, these injuries seem innocuous to those outside of the medical profession. Unfortunately, this is not the case. Simple tasks like holding a cup of coffee are impossible for most skiers suffering from these injuries. Tasks that require motion of a thumb injured in this manner are difficult if not impossible to perform.

The present invention helps prevent these debilitating injuries by incorporating an articulated break-over mechanism into the pole design. The break-over mechanism allows the pole handle to articulate when an abnormally high bending force is applied to the handle, as in an accident. The break-over mechanism includes mating handle and shaft bases that are radially enlarged relative to the shaft. Prior to and during initial handle articulation, this radial enlargement of the mating handle and shaft bases enhances pole stability and integrity by distancing the fulcrum point of the articulation mechanism from the pole axis. As the handle approaches full articulation, the enlarged handle and shaft bases further enhance pole stability and integrity by reducing the distance from the fulcrum point to the pole axis, thereby reducing spring actuation. Both the enlarged handle and shaft bases and the movable fulcrum point they provide render the invention both distinguishable from and superior to the prior art.

SUMMARY OF THE INVENTION

Therefore, it is an object of the invention to provide an athletic pole that provides enhanced user safety.

It is another object of the invention to provide an athletic pole with an articulating break-over feature that permits handle articulation when an abnormally high bending force is applied by the user.

It is another object of the invention to provide an athletic pole that permits the user to adjust the tension between the articulating pole handle and the pole shaft.

It is another object of the invention to provide an athletic pole with an articulating break-over mechanism that reduces the tension between the articulating pole handle and the pole shaft after initial articulation of the handle.

It is another object of the invention to provide an athletic pole with an articulating break-over mechanism that maximizes pole stability and minimizes pole stress during articulation.

It is another object of the invention to provide an athletic pole that limits rotational motion of the handle relative to the shaft.

It is another object of the invention to provide an athletic pole with a handle and a shaft that retain coaxial orientation when normal bending forces are applied to the handle.

These objects of the present invention are achieved in the preferred embodiments disclosed below by providing an athletic pole adapted for minimizing injuries to the hand and wrist of the user in the event of an accident. The pole includes a handle having an enlarged handle base, a shaft extending from the handle and including a proximal end adjacent the handle, a distal end, and an enlarged shaft base on the proximal end that normally engages the handle base. The pole also includes attachment means for attaching the handle to the shaft and biasing means exerting sufficient tension on the attachment means for biasing the attachment means to maintain the handle base and the shaft base in a mating, coaxial position during normal use. The periphery of the handle base and a surface of the shaft base collectively form a fulcrum for permitting controlled, tensioned articulation of the handle relative to the shaft. Such articulation results when a predetermined bending force is applied to the pole that is sufficient to overcome the tension of the biasing means on the attachment means.

According to one preferred embodiment of the invention, the handle base is conical.

According to another preferred embodiment of the invention, a surface of the shaft base is annular.

According to yet another preferred embodiment of the invention, the attachment means comprises a cable.

According to yet another preferred embodiment of the invention, the biasing means comprises a spring.

According to yet another preferred embodiment of the invention, tension adjustment means are provided for cooperation with the biasing means to exert a selected predetermined tension on the attachment means in order to accommodate users of varying sizes and weights.

According to yet another preferred embodiment of the invention, the handle base is fixedly secured to the handle.

According to yet another preferred embodiment of the invention, the biasing means exerts sufficient tension to return the handle to a position coaxial with the shaft upon reduction of the predetermined bending force below a predetermined quantum.

According to yet another preferred embodiment of the invention, a raised alignment post defines an inner boundary of a surface of the shaft base and an inner boundary that limits the movement of the handle base across the shaft base during handle articulation. The alignment post includes a centrally located opening through which the attachment means extends.

According to yet another preferred embodiment of the invention, the alignment post is annular.

According to yet another preferred embodiment of the invention, the shaft base includes axial splines formed with the alignment post, such splines having complimentary grooves in the handle base. The splines and grooves are designed to restrict rotational motion of the handle and the shaft both when the handle is not articulated and during articulation.

According to yet another preferred embodiment of the invention, the shaft includes a rim that, during handle articulation, limits the movement of the handle base across the shaft base by forming an outer boundary of a surface of the shaft base, and, upon release of the handle, assists the handle in resuming a normal coaxial position relative to the shaft.

According to yet another preferred embodiment of the invention, the rim is annular and extends around the periphery of the shaft base.

According to one preferred embodiment of the invention, an athletic pole is provided which is adapted for minimizing injuries to the hand and wrist of the user in the event of an accident. The pole includes a handle having an enlarged handle base, a shaft extending from the handle and including a proximal end adjacent the handle, a distal end, and an enlarged shaft base on the proximal end that normally engages the handle base. The shaft base includes a raised alignment post defining an inner boundary of a surface of the shaft base and an inner boundary that limits the movement of the handle base across the shaft base during handle articulation. The shaft base also includes a rim that, during handle articulation, limits the movement of the handle base across the shaft base by forming an outer boundary of a surface of the shaft base, and, upon release of the handle, assists the handle in resuming a normal coaxial position relative to the shaft. The pole also includes a cable for attaching the handle to the shaft and a spring exerting sufficient tension on the cable for biasing said cable to maintain the handle base and the shaft base in a mating, coaxial position during normal use. The periphery of the handle base and a surface of the shaft base collectively define a fulcrum for permitting controlled, tensioned articulation of the handle relative to the shaft. Such articulation results when a predetermined bending force is applied to the pole that is sufficient to overcome the tension of the spring on the cable, the spring exerting sufficient tension to return the handle to a position coaxial with the shaft upon reduction of the predetermined bending force below a predetermined quantum.

According to one preferred embodiment of the invention, an athletic pole is provided which is adapted for minimizing injuries to the hand and wrist of the user in the event of an accident. The pole includes a handle having an enlarged, conical handle base, a handgrip detachably mounted on the handle, and a shaft extending from the handle and including a proximal end adjacent the handle, a distal end, and an enlarged shaft base on the proximal end that normally engages the handle base. The shaft base includes a raised, annular alignment post that defines an inner boundary of a surface of the shaft base and an inner boundary that limits the movement of the handle base across the shaft base during handle articulation. The shaft base also includes axial splines formed with the alignment post, the splines having complimentary grooves in the handle base; the splines and grooves are designed to restrict rotational motion of the handle and shaft while the handle is not articulated. Further, the shaft base also includes an annular rim that extends around the periphery of the shaft base. During handle articulation, the rim limits the movement of the handle base across the shaft base by forming an outer boundary of a surface of the shaft base, and, upon release of the handle, it assists the handle in resuming a normal coaxial position relative to the shaft. The pole also includes a cable for attaching the handle to the shaft and an adjustable spring for exerting a selected predetermined tension on the cable for biasing the cable to maintain the handle base and the shaft base in a mating, coaxial position during normal use. The periphery of the handle base and the periphery of the shaft base collectively form a fulcrum for permitting controlled, tensioned articulation of the handle relative to the shaft. Such articulation results when a predetermined bending force is applied to the pole that is sufficient to overcome the tension of the spring on the cable. The spring also exerts sufficient tension to return the handle to a position coaxial with the shaft upon reduction of the predetermined bending force below a predetermined quantum. Finally, the pole also includes tension adjustment means for cooperation with the spring to exert a selected predetermined tension on the attachment means in order to accommodate users of varying sizes and weights.

BRIEF DESCRIPTION OF THE DRAWINGS

Some of the objects of the invention have been set forth above. Other objects and advantages of the invention will appear as the description proceeds when taken in conjunction with the following drawings, in which:

FIG. 2A is a vertical cross-section of the spring cap used to anchor the upper end of the compression spring in the pole handle;

DESCRIPTION OF THE PREFERRED EMBODIMENT AND BEST MODE

Figure 1:
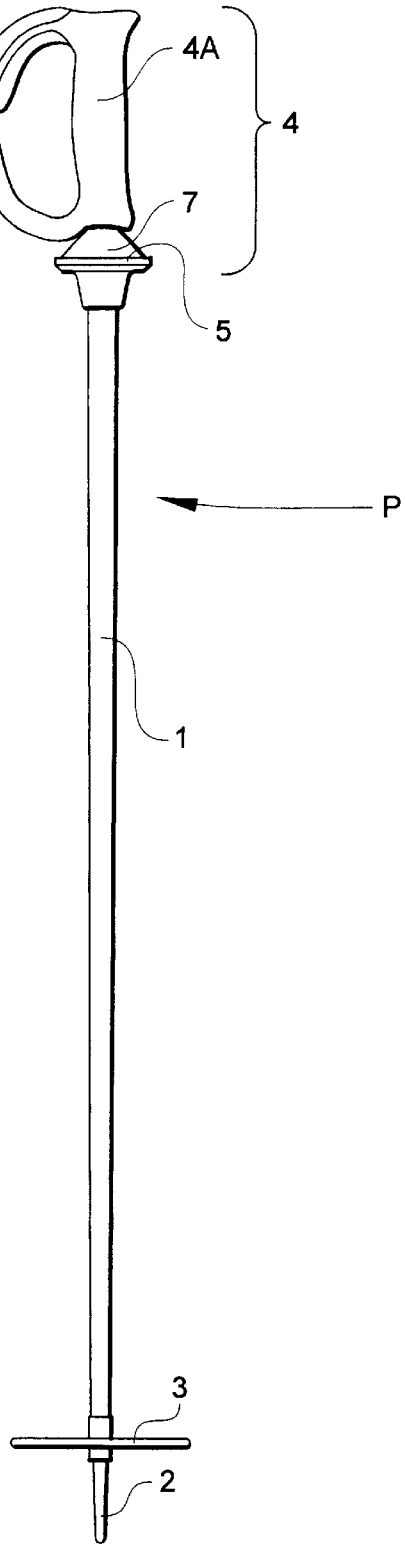
FIG. 1 is a side elevation of the athletic pole with the break-over mechanism located between the handgrip and the pole shaft.

Referring now specifically to the drawings, an athletic pole product according to a preferred embodiment of the invention is illustrated broadly at reference letter P in FIG. 1. A conventional long, thin shaft 1 with a snow-penetrating tip 2 and a penetration limiting basket 3 is connected to a handle 4 comprising a handgrip 4A and a handle body 7. The connection is accomplished by a spring-loaded articulating joint 5. The articulating joint 5 provides a break-over feature that limits the force that the ski pole P can apply to the hand, and is the subject of this invention.

Figure 2:
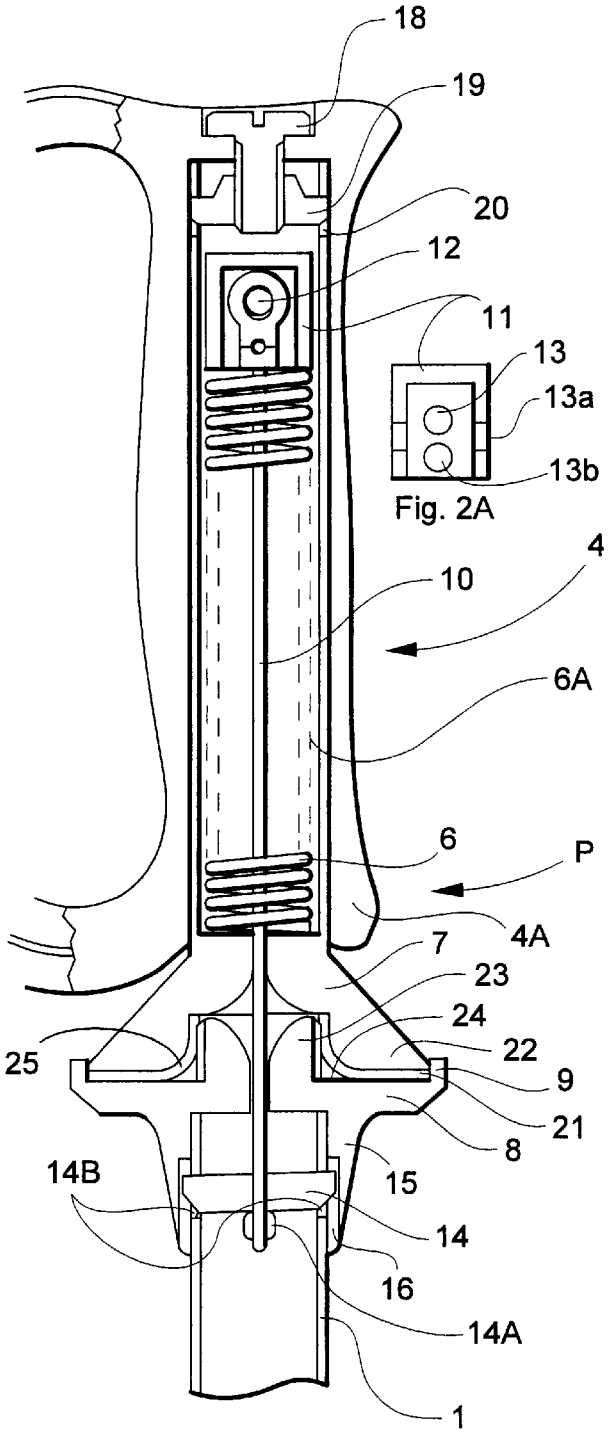
FIG. 2 is a vertical cross-section of a preferred embodiment of the invention with a compression spring located in the handle, as it is adapted to large diameter, hollow shafts.

A preferred design arrangement that accomplishes the desired objectives is shown in FIG. 2, which is a cross-sectional view of the handle 4 of the safety ski pole P. Referring now to FIG. 2, a compression spring 6 is utilized to provide a seating force between the handle body 7 and a matching seat comprising a shaft base 8, which is attached to the shaft 1. Coaxial centering of the handle 4 and the shaft 1 under normal loads imposed during skiing is accomplished by the matching surfaces and features of the handle body 7 and the seat 8, and a restraining rail comprising a rim 9 around the perimeter of the seat 8.

Figure 3:
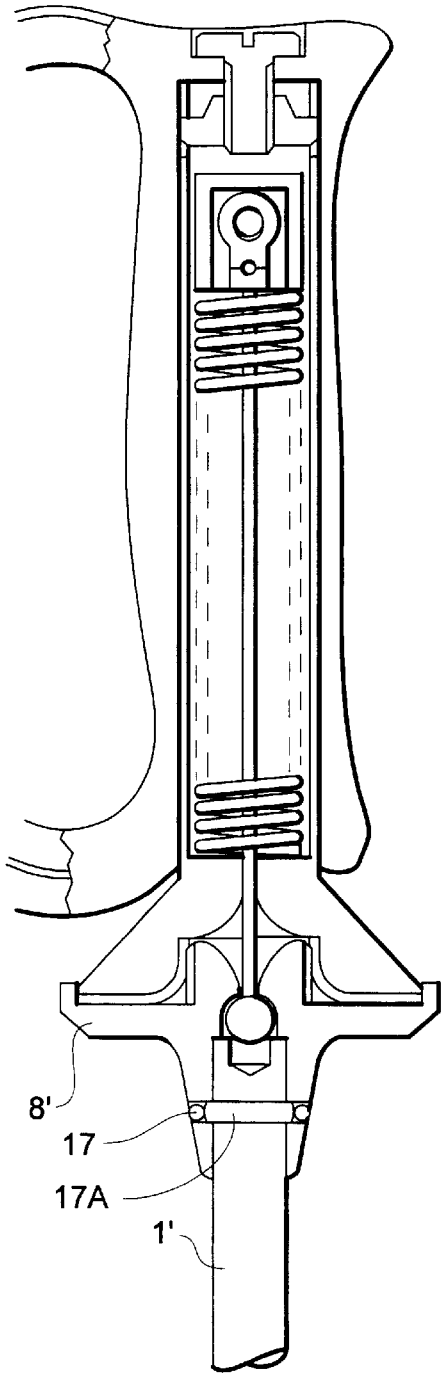
FIG. 3 is a vertical cross-section showing a variation of the preferred embodiment of the invention as it is adapted to small diameter, solid shafts.

In the embodiment shown in FIG. 2, the compression spring 6 resides in a guiding handle cavity 6A in the handle body 7 and its compressive force is transmitted from the handle body 7 to the seat 8 and the shaft 1 by attachment means comprising a flexible cable 10. The upper end of the cable 10 is anchored to a slidable spring cap 11 by means of a cross pin 12 inserted in a cross hole 13 in the spring cap 11. The cable 10 is secured at its lower end by a cross member 14 and a cable-end anchor 14A, the cross member 14 residing in the holes 14B in the shaft 1 and kept in place, in this instance, by a collar 15 of the seat 8. The cross member 14 extends beyond the outer diameter of the shaft 1 into axial slots 16 in the seat 8 in order to radially index the seat 8 to the shaft 1. Other means of retention may be used, such as that shown in FIG. 3, which is particularly adaptable to small diameter and/or solid shafts. In this instance, a cross pin 17A is held in place by a retaining ring 17. Other alternatives are to thread or cement the seat 8' to the shaft 1'.

Referring again to FIG. 2, the level of transverse force that is required to be applied to the handle 4 to initiate the breakaway action is a function of the combination of the moment arm created by the radial dimension of a handle base 22 and the seating force provided by the spring 6 acting through the flexible cable 10. A practical combination will have the diameter of the handle base 22 significantly larger than that of the shaft 1 and/or the handle body 7 where it interfaces with the handgrip 4A in order for a practical spring 6 to be able to reside within the dimensional confines of the handle 4 or the shaft 1. Once the handle base 22 is selected, various means can be employed to provide the desired resistance to articulation by presenting the assembly compression of the spring 6. The means employed in the configuration shown in FIG. 2 and FIG. 2A is to assemble an anchor pin 12 into a selected pair of cross-holes 13, 13*a*, or 13*b* in the spring cap 11.

As shown in FIG. 2, the handle body 7 is inserted into the handgrip 4A. The handgrip 4A, which is customarily a molded elastomer, is held in place by a button head screw 18 threaded into a cross member 19 which is inserted into the cross holes 20 in the handle body 7 and held in place by the handgrip 4A upon assembly. Referring again to both FIG. 2 and FIG. 2A, while the handgrip 4A can be held in place by friction or by an adhesive, it is convenient to be able to remove it so that the user may adjust the handle tension by selecting a different pair of cross holes 13, 13*a*, or 13*b* in the spring cap 11 in which to insert anchor pin 12.

Figure 4:
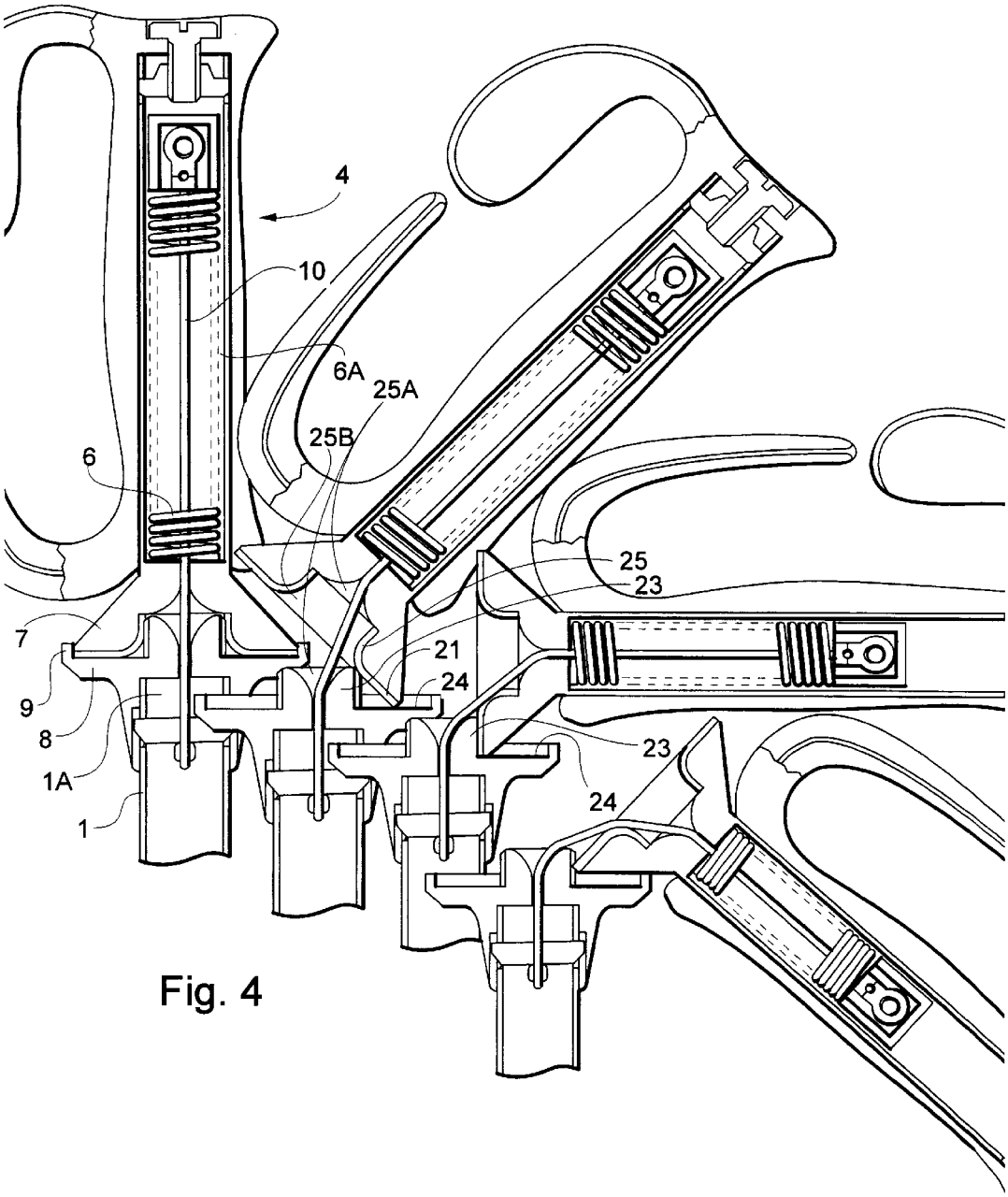
FIG. 4 is a series of sequential, vertical cross-section views that illustrates the operation of the articulated break-over mechanism as it goes through stages of handle articulation relative to the pole shaft.

When the spring tension is adjusted properly, the handle 4 and the shaft 1 will maintain a coaxial position under normal bending moments imposed by the skier's hand, wrist, and arm, as reacted by the shaft 1 against normally encountered surfaces. However, if a higher than normal bending moment is experienced, for instance as the result of a fall that may trap the pole P under the skier's body or under his ski(s), as shown in FIG. 4, the handle 4 will pivot with an edge 21 of the handle base 22 forming the fulcrum, and the channel between the rail 9 and a central alignment post 23 of the seat 8 forming the pivot point. When the handle 4 moves to a large articulation angle, the handle base 22 slides across a surface 24, coming to rest against the post 23 of the seat 8, where it remains as the handle 4 articulates further. The handle base 22 is prevented from moving further toward the center of the seat 8 by the combined restraining action of the post 23 and the cable 10 as the handle 4 is articulated to extreme angles, even beyond 90 degrees. The flared holes 25A in the handle body 7 and the seat 8 through which the cable 10 passes are suitably radiused to prevent excessive bending stresses in the cable 10, and the small diameter of the holes 25A fit closely to the cable 10 to prevent snow from entering the handle cavity 6A or a shaft cavity 1A. The spring 6 will be extended beyond the initial adjustment extension as a result of the handle articulation, but the resulting load on the skier's hand, thumb and wrist will not be sufficient to cause injury. Once the handle base 22 rests against the post 23, the articulating force significantly reduces, becoming much less than the initiating force, as a result of a reduction in the moment arm as the edge 21 of the handle base 22 moves toward the post 23.

When the bending moment on the handle 4 is released, it will automatically resume its normal position coaxial with the shaft 1.

The post 23 of the seat 8 is splined, fitting loosely but non-rotatably into a similarly splined pocket 25B in the base of the handle body 7. Spline grooves 25 in the handle body 7 extend axially from the upper end of the pocket 25B, then bend around the lower end of the pocket 25B, extending radially to the outer diameter of the handle base 22. As the handle 4 is articulated relative the shaft 1, one or more of the splines on the post 23 will engage matching spline grooves 25 of the handle base 22 throughout the range of articulation of the handle 4, thereby resisting rotation of one relative to the other. This feature resists misindexing of the handle 4 and the shaft 1, each of which may have non-symmetrical features that require alignment. Additionally, this prevents twisting of the flexible cable 10 that otherwise may result from repeated actuations.

Figure 5:
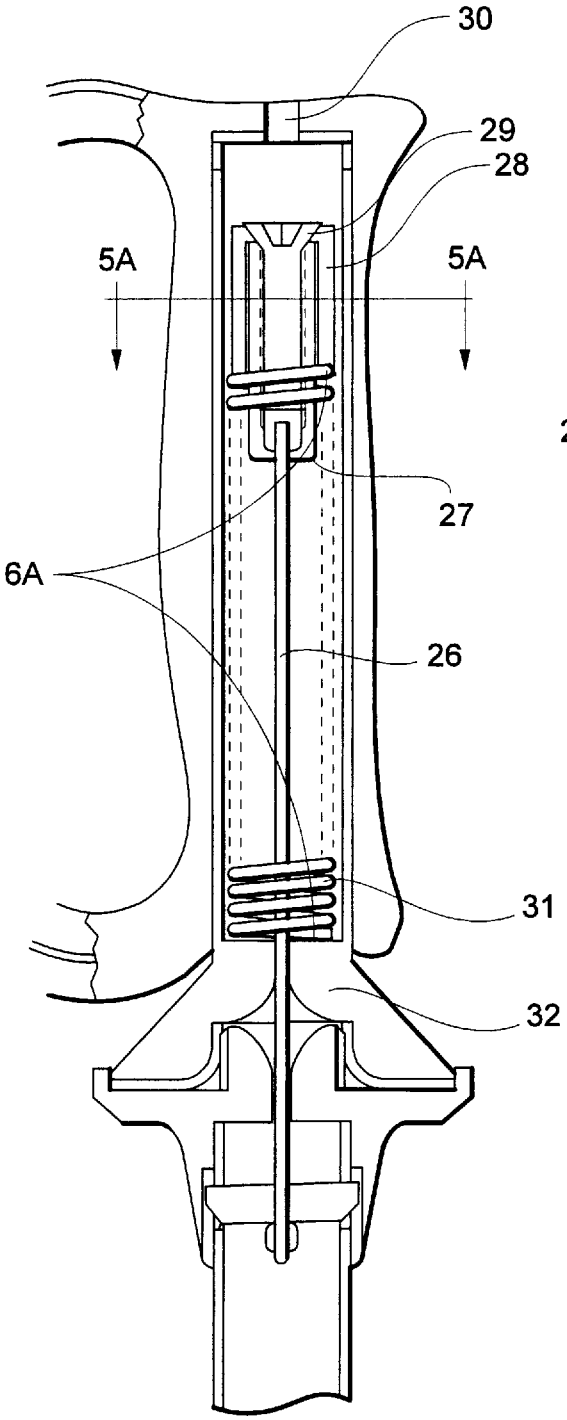
FIG. 5 is a vertical cross-section that shows an arrangement permitting adjustment of the articulation resistance of the handle without disassembly of the handle.
Figure 5A:
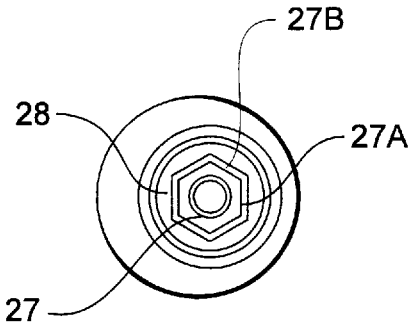
FIG. 5A is a horizontal cross-section taken through line 5A—5A of FIG. 5 that shows the spring cap and the cable terminal inside the pole handle.

FIG. 5 and FIG. 5A show an alternative arrangement for providing spring compression adjustment. The flexible cable 26 has an internally threaded terminal 27 attached to its upper end. This terminal 27 has a hexagonal exterior surface 27A to prevent its rotation in a hexagonal hole 27B in the spring cap 28 while permitting axial relative translation as determined by the position of an adjusting screw 29, accessed through a hole 30. In this embodiment, the compression spring 31 does not have squared and ground ends and the spring seats in the spring cap 28 and the handle body 32 are configured to fit the plain cut coil ends 26A of the spring 31. This causes the adjusting torque to be transmitted from the screw 29 to the cable terminal 27 through the hexagonal hole 27B in the spring cap 28 through the spring 31 to the handle body 32, thereby preventing twisting of the cable 26 during adjustment. For illustrative purposes, the spring 31 is shown compressed to the maximum allowable initial force setting.

Figure 6:
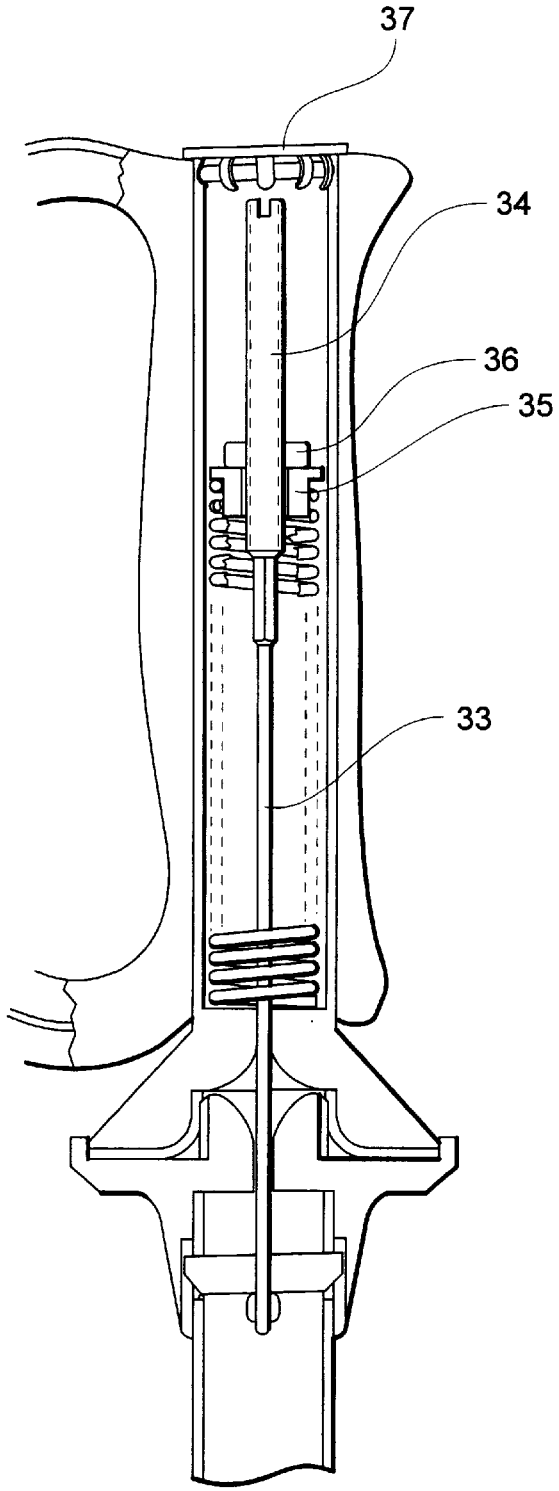
FIG. 6 is a vertical cross-section that shows another arrangement that permits adjustment without disassembly.

FIG. 6 shows still another method of providing adjustability of spring compression. The flexible cable 33 has an externally threaded terminal 34 attached to its upper end and extending through the spring cap 35, which is retained by an adjusting nut 36. Adjustment of the position of the nut 36 without twisting the cable 33 is accomplished by holding the terminal 34 with a screwdriver while turning the nut 36. Access to the terminal 34 and the nut 36 is provided by removal of a spring-clip retained cover 37.

Figure 7:
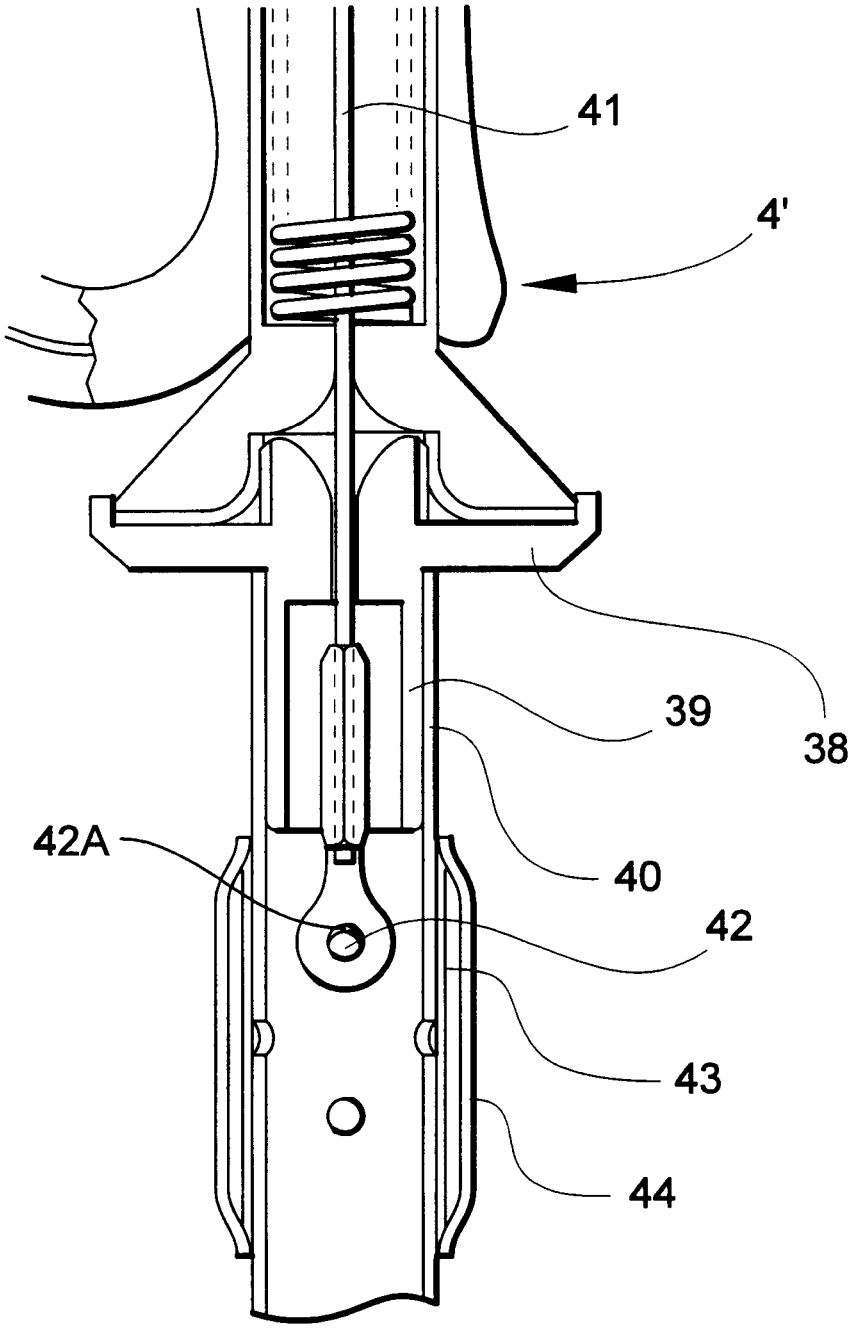
FIG. 7 is a vertical cross-section that shows an alternate method of attachment of the handle to large diameter, hollow shafts.

FIG. 7 shows an alternate method of joining the handle 4' to the shaft 40. The seat 38 includes with a cylindrical projection 39 that pilots inside the shaft 40, with the upper end of the shaft 40 seating on the underside of the seat 38. The flexible cable 41 is anchored at the lower end by a cross member 42 residing in a pair of transverse holes 42A in the shaft 40. The seat 38 and the shaft 40 are kept in close contact by the tension in the cable 41. The cross member 42 is suitably retained transversely; in this embodiment, this is achieved by a sheath 43 held in place by an elastomeric sleeve 44.

Figure 8:
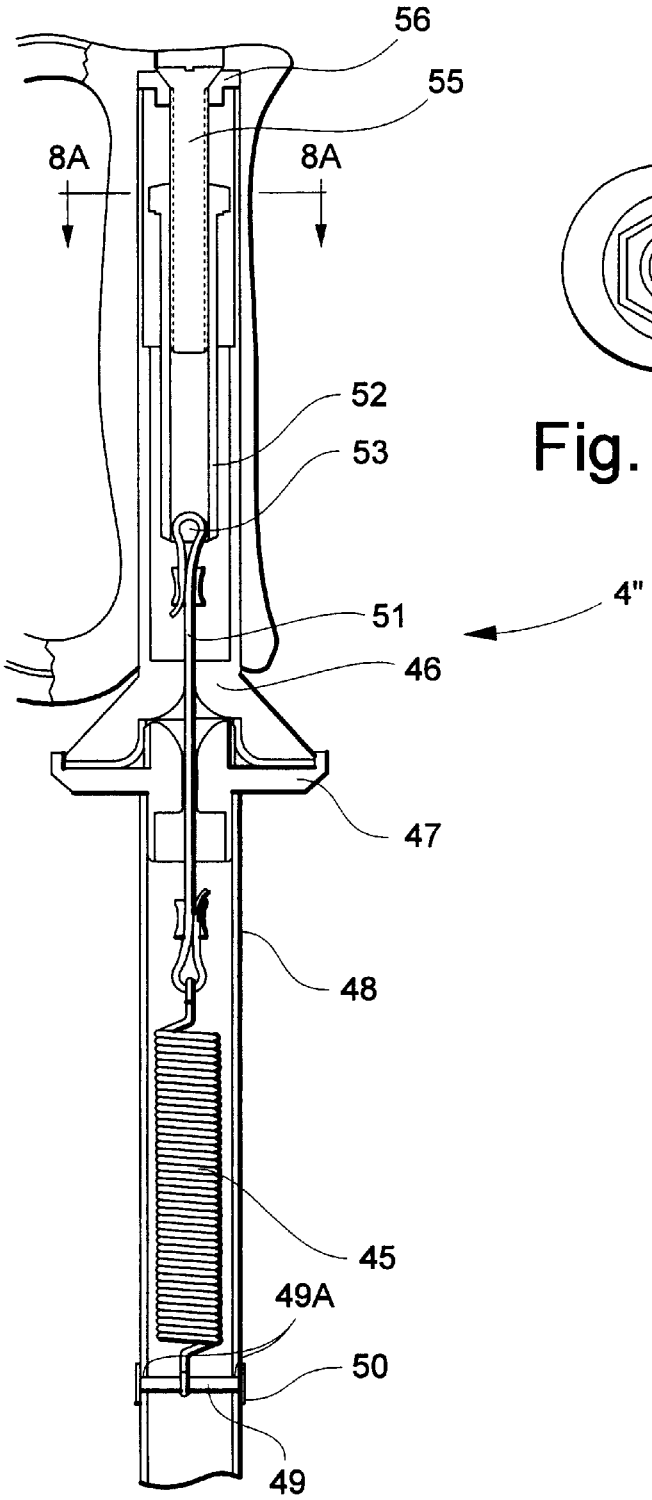
FIG. 8 is a vertical cross-section of an embodiment of the invention that utilizes a tension spring located in the shaft, with means for tension adjustment, without disassembly, located in the handle.
Figure 8A:
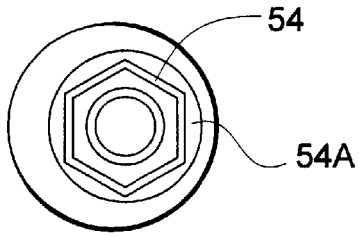
FIG. 8A is a horizontal cross-section taken through line 8A—8A of FIG. 8 that shows a hexagonal portion of the anchor member used to secure the upper end of the cable.

While the examples shown in FIGS. 2 through 7 have employed a compression spring located in the ski pole handle, the objective of this invention can be achieved through other combination of spring types and locations, for instance: a tension spring located in the handle; a compression spring located in the shaft; or a tension spring located in the shaft. Additionally, compound springs may be used. An example of an alternate spring arrangement is shown in FIG. 8. Referring to FIG. 8, a tension spring 45 is utilized to provide a seating force between the handle body 46 of the handle 4" and the matching seat 47, which is attached to the shaft 48. A tension spring 45 is anchored at its lower end by a pin 49, which resides in holes 49A in the shaft 48 and is kept in place by, in this instance, a sleeve 50. Other means of retention may be used. The spring force is transferred to the handle 4" through the flexible cable 51, which is attached to an anchor member 52 by means of a second pin 53. As shown in FIG. 8 and FIG. 8A, the anchor member 52 is kept from rotating relative to the handle 4" by a hexagonal portion 54 of the anchor member 52 that is axially slidable through a matching hexagonal cavity 54A in the handle body 46. The axial position of the anchor member 52 is moveable, to permit adjustment of the spring tension through use of a screw 55 threaded into the anchor member 52. The head of the screw 55 is seated on a anchor member 56, which in turn rests centrally on the handle body 46.

A safety athletic pole is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. An athletic pole adapted for minimizing injuries to the hand and wrist of the user in the event of an accident, said athletic pole comprising:

(a) a handle having an enlarged handle base;

(b) a shaft extending from the handle and including a proximal end adjacent the handle, a distal end, and an enlarged shaft base on the proximal end engageable with the handle base;

(c) attachment means for attaching the handle to the shaft;

(d) biasing means exerting sufficient tension on said attachment means for biasing said attachment means to maintain the handle base and the shaft base in a mating, coaxial aligned position when any bending forces applied to the pole are insufficient to overcome the tension of the biasing means on the attachment means, the periphery of the handle base and the periphery of the shaft base collectively forming a fulcrum point thereon for permitting controlled, tensioned articulation of the handle relative to the shaft resulting from an application of a predetermined bending force on the pole sufficient to overcome the tension of the biasing means on the attachment means for pivoting the handle to an articulated position relative to the shaft;

(e) a raised alignment post defining an inner boundary of a surface of the shaft base and an inner boundary limiting movement of the handle base across the shaft base during handle articulation, wherein said alignment post includes a centrally located opening therein through which the attachment means extends; and (f) axial splines formed with the alignment post, the splines having complimentary grooves in the handle base, said splines and grooves designed to restrict rotational motion of the handle relative to the shaft both when the handle is in the coaxially aligned position and in the articulated position.

2. An athletic pole according to claim 1, wherein the handle base is conical.

3. An athletic pole according to claim 1, wherein a surface of the shaft base is annular.

4. An athletic pole according to claim 1, wherein the attachment means comprises a cable.

5. An athletic pole according to claim 1, wherein the biasing means comprises a spring.

6. An athletic pole according to claim 5, wherein tension adjustment means are provided for cooperation with the spring to exert a selected predetermined tension on the attachment means to accommodate users of varying sizes and weights.

7. An athletic pole according to claim 1, wherein the handle base is fixedly secured to the handle.

8. An athletic pole according to claim 1, wherein the biasing means exerts sufficient tension to return the handle to a position coaxial with the shaft upon reduction of the predetermined bending force below a predetermined quantum.

9. An athletic pole according to claim 1, wherein the alignment post is annular.

10. An athletic pole according to claim 1, wherein the shaft base includes a rim that, during handle articulation, limits the movement of the handle base across the shaft base by forming an outer boundary of a surface of the shaft base, and, upon release of the handle, assists the handle in resuming a normal coaxial position relative to the shaft.

11. An athletic pole according to claim 10, wherein the rim is annular and extends around the periphery of the shaft base.

12. An athletic pole adapted for minimizing injuries to the hand and wrist of the user in the event of an accident, said athletic pole comprising:

(a) a handle having an enlarged handle base;

(b) a shaft extending from the handle and including a proximal end adjacent the handle, a distal end, and an enlarged shaft base on the proximal end engageable with the handle base, said shaft base comprising a raised alignment post defining an inner boundary of a surface of the shaft base and an inner boundary limiting movement of the handle base across the shaft base during handle articulation, and a rim that, during handle articulation, limits the movement of the handle base across the shaft base by forming an outer boundary of a surface of the shaft base, and, upon release of the handle, assists the handle in resuming a coaxially aligned position relative to the shaft, and axial splines formed with the alignment post, the splines having complimentary grooves in the handle base, said splines and grooves designed to restrict rotational motion of the handle relative to the shaft both when the handle is in the coaxially aligned position and in an articulated position;

(c) a cable for attaching the handle to the shaft; and (d) a spring exerting sufficient tension on said cable for biasing said cable to maintain the handle base and the shaft base in the coaxially aligned position when any bending forces applied to the pole are insufficient to overcome the tension of the biasing means on the attachment means, the periphery of the handle base and a surface of the shaft base collectively defining a fulcrum thereon for permitting controlled, tensioned articulation of the handle relative to the shaft resulting from an application of a predetermined bending force on the pole sufficient to overcome the tension of the spring on the cable for pivoting the handle to the articulated position relative to the shalt, said spring exerting sufficient tension to return the handle to the coaxially aligned position relative to the shaft upon reduction of the predetermined bending force below a predetermined quantum.

13. An athletic pole according to claim 10, wherein tension adjustment means are provided for cooperation with the spring to exert a selected predetermined tension on the attachment means to accommodate users of varying sizes and weights.

14. An athletic pole according to claim 12, wherein the handle base is fixedly secured to the handle.

15. An athletic pole according to claim 12, wherein a surface of the shaft base, the alignment post, and the rim are annular.

16. An athletic pole according to claim 12, wherein the handle base is conical.

17. An athletic pole adapted for minimizing injuries to the hand and wrist of the user in the event of an accident, said athletic pole comprising:

(a) a handle having an enlarged, conical handle base;

(b) a handgrip detachably mounted on the handle;

(c) a shaft extending from the handle and including a proximal end adjacent the handle, a distal end, and an enlarged shaft base on the proximal end engageable with the handle base, said shaft base comprising a raised, annular alignment post defining an inner boundary of a surface of the shaft base and an inner boundary limiting movement of the handle base across the shaft base during handle articulation, and axial splines formed with the alignment post, said splines having complimentary grooves in the handle base, said splines and grooves designed to restrict rotational motion of the handle relative to the shaft both while the handle is in a coaxially aligned position relative to the shaft and in an articulated position, and an annular rim extending around the periphery of the shaft base that, during handle articulation, limits the movement of the handle base across the shaft base by forming an outer boundary of a surface of the shaft base, and, upon release of the handle, assists the handle in resuming the coaxially aligned position relative to the shaft;

(d) a cable for attaching the handle to the shaft;

(e) an adjustable spring for exerting a selected predetermined tension on said cable for biasing said cable to maintain the handle base and the shaft base in the coaxial aligned position when any bending forces applied to the pole are insufficient to overcome the tension of the biasing means on the attachment means, the periphery of the handle base and a surface of the shaft base collectively forming a fulcrum thereon for permitting controlled, tensioned articulation of the handle relative to the shaft resulting from an application of a predetermined bending force on the pole sufficient to overcome the tension of the spring on the cable for pivoting the handle to the articulated position relative to the shaft, said spring also exerting sufficient tension to return the handle to the coaxially aligned position relative to the shaft upon reduction of the predetermined bending force below a predetermined quantum; and (f) tension adjustment means for cooperation with the spring to exert a selected predetermined tension on the attachment means to accommodate users of varying sizes and weights.

* * * * *

UNITED STATES PATENT AND TRADEMARK OFFICE

CERTIFICATE OF CORRECTION

PATENT NO. : 6,070,907
DATED : June 6, 2000
INVENTOR(S) : Bujold et al.

It is certified that error appears in the above-identified patent and that said Letters Patent is hereby corrected as shown below:

Drawing sheet,
Consisting of Fig. 5, should be deleted to be replaced with the drawing as shown below.

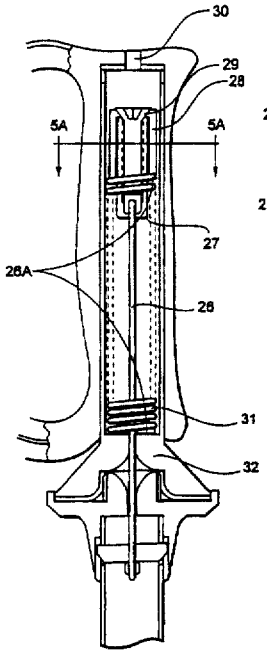

Fig. 5

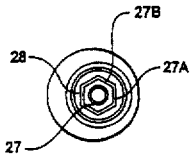

Fig. 5A

Signed and Sealed this

Sixteenth Day of October, 2001

*Attest:*

Nicholas P. Godici

NICHOLAS P. GODICI
*Acting Director of the United States Patent and Trademark Office*

*Attesting Officer*